US010073378B2

(12) United States Patent
Kim et al.

(10) Patent No.: US 10,073,378 B2
(45) Date of Patent: Sep. 11, 2018

(54) DEVELOPER CARTRIDGE AND ELECTROPHOTOGRAPHIC IMAGE FORMING APPARATUS EMPLOYING THE SAME

(71) Applicant: S-Printing Solution Co., Ltd., Suwon-si (KR)

(72) Inventors: Jin-hong Kim, Gwangmyeong-si (KR); Jae-rae Lee, Suwon-si (KR); Ho-young Lee, Yongin-si (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/693,780

(22) Filed: Sep. 1, 2017

(65) Prior Publication Data

US 2018/0157193 A1 Jun. 7, 2018

(30) Foreign Application Priority Data

Dec. 1, 2016 (KR) ..... 10-2016-0162923

(51) Int. Cl.
*G03G 15/08* (2006.01)

(52) U.S. Cl.
CPC ..... *G03G 15/0874* (2013.01); *G03G 15/087* (2013.01); *G03G 15/0881* (2013.01); *G03G 15/0891* (2013.01)

(58) Field of Classification Search
CPC ..... G03G 15/0874
See application file for complete search history.

(56) References Cited

U.S. PATENT DOCUMENTS

| | | | | |
|---|---|---|---|---|
| 9,285,707 | B2 | 3/2016 | Matsushita et al. | |
| 2007/0019994 | A1 | 1/2007 | Choi | |
| 2010/0254732 | A1 | 10/2010 | Taguchi et al. | |
| 2014/0119780 | A1 | 5/2014 | Hori et al. | |
| 2016/0170356 | A1 | 6/2016 | Mabuchi et al. | |
| 2017/0285527 | A1* | 10/2017 | Okabe | G03G 15/0889 |

FOREIGN PATENT DOCUMENTS

| | | |
|---|---|---|
| EP | 0518682 B1 | 8/1995 |

* cited by examiner

*Primary Examiner* — Clayton E Laballe
*Assistant Examiner* — Jas Sanghera
(74) *Attorney, Agent, or Firm* — Staas & Halsey LLP

(57) ABSTRACT

A developer cartridge includes: a housing including a developer outlet; a conveying member configured to convey a developer to the developer outlet and including a spiral member rotatably installed in the housing; and a developer bag configured to accommodate the developer, be installed in the housing, and rotate in connection with the conveying member, the developer bag including an opening for discharging the developer into the housing.

20 Claims, 13 Drawing Sheets

DEVELOPER CARTRIDGE AND ELECTROPHOTOGRAPHIC IMAGE FORMING APPARATUS EMPLOYING THE SAME

CROSS-REFERENCE TO RELATED APPLICATIONS

This application claims the benefit of Korean Patent Application No. 10-2016-0162923, filed on Dec. 1, 2016, in the Korean Intellectual Property Office, the disclosure of which is incorporated herein in its entirety by reference.

BACKGROUND

1. Field

The present disclosure relates to developer cartridges and electrophotographic image forming apparatuses employing the same.

2. Description of the Related Art

An image forming apparatus using electrophotography forms a visible toner image on a photoconductor by supplying a toner to an electrostatic latent image formed on the photoconductor, transfers the toner image onto a recording medium, and then fixes the transferred toner image on the recording medium, thereby printing an image on the recording medium. A developing unit contains a developer (toner) and forms the visible toner image on the photoconductor by supplying the toner to the electrostatic latent image formed on the photoconductor.

The developer may be contained in a developer cartridge. The developer may be supplied from the developer cartridge to the developing unit. The developer cartridge includes a container for containing the developer, and an outlet for discharging the developer. A paddle for carrying the developer to the outlet is included in the container. The outlet is in a length-direction side of the container. The paddle has a length corresponding to the length of the container. When the developer near the outlet is supplied to the developing unit and thus the amount of the developer in the container varies in a longitudinal direction, a load applied to the paddle by the developer may not be uniform in the longitudinal direction and thus a paddle shaft may be damaged. In addition, since the paddle rotates while scraping an internal wall of the container, a driving load of the paddle is large. Furthermore, when the paddle is continuously driven, since the developer provided in the container is stirred, stress may accumulate in the developer contained in the container and thus properties of the developer may deteriorate. A process of filling the developer into a container of a developer cartridge is part of a process of manufacturing the developer cartridge, and thus, the developer may be exposed during the process, which makes it difficult to maintain cleanliness of a manufacturing facility.

SUMMARY

Provided are developer cartridges capable of reducing developer stress, and electrophotographic image forming apparatuses employing the same.

Additional aspects will be set forth in part in the description which follows and, in part, will be apparent from the description, or may be learned by practice of the presented embodiments.

According to an aspect of an embodiment, a developer cartridge includes: a housing including a developer outlet; a conveying member configured to convey a developer to the developer outlet and including a spiral member rotatably installed in the housing; and a developer bag configured to accommodate the developer, be installed in the housing, and rotate in connection with the conveying member, the developer bag including an opening for discharging the developer into the housing.

The developer bag may include a flexible wall, and a support wall filled with gas to maintain a shape of the developer bag.

The support wall may be shaped to be convex inward with respect to the flexible wall.

The support wall may be shaped to be convex outward with respect to the flexible wall.

The support wall may be shaped to be convex inward and outward with respect to the flexible wall.

The opening may be provided in the flexible wall, and the support wall may include an opening forming wall located around the opening to maintain a shape of the opening.

The opening forming wall may surround the opening.

Corners of the opening may have a curved shape.

The developer cartridge may further include a first sealing member removably attached to the flexible wall to seal the opening.

One end of the first sealing member may extend outside of the housing.

An outlet through which the first sealing member may be discharged is provided in the housing, and the developer cartridge may further include: a second sealing member configured to prevent leakage of a developer through the outlet.

The support wall may include a spiral shaped portion having a same spiral direction as that of the conveying member.

The opening may not overlap with the developer outlet.

The conveying member may include a spiral coil, and the developer bag may be inserted into a central portion of the spiral coil.

An outermost diameter of the developer bag may be greater than an inner diameter of the central portion of the spiral coil.

The developer cartridge may further include a stopper configured to prevent the developer bag from being moved to the developer outlet by a thrust force according to a rotation of the conveying member.

The stopper may include a hook provided in the developer bag and caught by the conveying member.

According to an aspect of another embodiment, an electrophotographic image forming apparatus may include: a main body including a developing unit supplying a developer to a photoconductor and forming a visible toner image; and the developer cartridge of claim 1, which supplies the developer to the developing unit.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
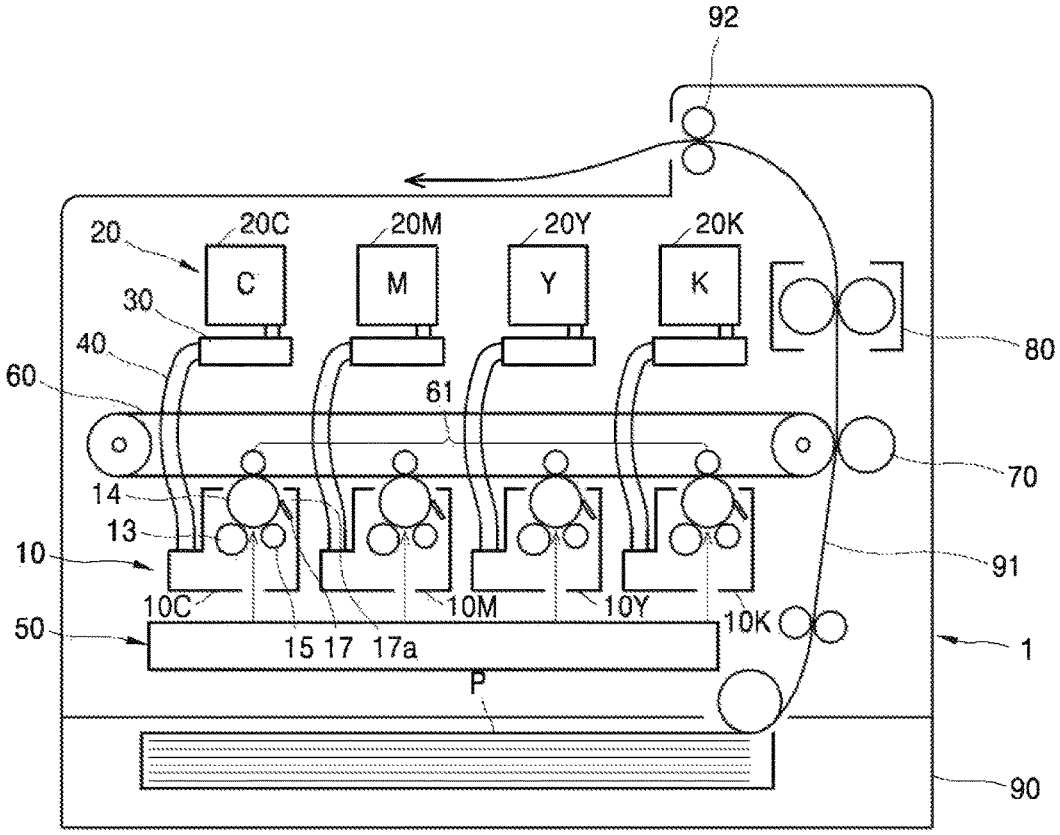
FIG. 1 is a structural view of an electrophotographic image forming apparatus according to an embodiment.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects. As used herein, the term "and/or" includes any and all combinations of one or more of the associated listed items.

FIG. 1 is a structural view of an electrophotographic image forming apparatus according to an embodiment. The image forming apparatus according to the current embodiment prints color images using electrophotography. Referring to FIG. 1, the image forming apparatus includes a plurality of developing units 10 and a plurality of developer cartridges 20 for containing developers. The developer cartridges 20 are also called 'toner cartridges'. The developer cartridges 20 are separately connected to the developing units 10, and the developers contained in the developer cartridges 20 are separately supplied to the developing units 10. The developer cartridges 20 and the developing units 10 may be individually replaced.

The developing units 10 include a plurality of developing units 10C, 10M, 10Y, and 10K for developing cyan (C), magenta (M), yellow (Y), and black (K) developers, respectively. The developer cartridges 20 may include a plurality of developer cartridges 20C, 20M, 20Y, and 20K for separately containing the C, M, Y, and K developers to be supplied to the developing units 10C, 10M, 10Y, and 10K. However, the scope of the present disclosure is not limited thereto, and the image forming apparatus may further include a plurality of developer cartridges 20 and a plurality of developing units 10 for containing and developing developers of various colors other than the above-mentioned colors, e.g., light magenta and white. In the following description, it is assumed that the image forming apparatus includes the developing units 10C, 10M, 10Y, and 10K and the developer cartridges 20C, 20M, 20Y, and 20K, and C, M, Y, and K following reference numerals denote elements for developing cyan, magenta, yellow, and black developers, respectively, unless the context clearly indicates otherwise.

Each developing unit 10 may include a photosensitive drum 14 for forming an electrostatic latent image on the surface thereof, and a developing roller 13 for developing the electrostatic latent image into a visible toner image by supplying the developer from the developer cartridge 20 to the electrostatic latent image. The photosensitive drum 14 is an example of a photoconductor for forming an electrostatic latent image on the surface thereof, and may include a conductive metal pipe, and a photosensitive layer provided on an outer circumferential surface of the conductive metal pipe. A charging roller 15 is an example of a charger for charging the photosensitive drum 14 to have a uniform surface potential. A charging brush, a corona charger, or the like may be employed instead of the charging roller 15.

The developing unit 10 may further include a charging roller cleaner (not shown) for removing a foreign substance adhered to the charging roller 15, e.g., the developer or dust, a cleaning member 17 for removing the developer remaining on the surface of the photosensitive drum 14 after an intermediate transfer operation to be described below, and a regulation member (not shown) for regulating the amount of the developer supplied to a developing area where the photosensitive drum 14 and the developing roller 13 face each other.

When a two-component development scheme is employed, the developer contained in the developer cartridge 20 may be a toner. A carrier may be contained in the developing unit 10. The developing roller 13 is spaced apart from the photosensitive drum 14 by several ten to several hundred microns. Although not shown in FIG. 1, the developing roller 13 may be a magnetic roller or may be configured as a developing sleeve and a magnetic roller provided in the developing sleeve. The toner is mixed with the carrier in the developing unit 10, and is adhered to the surface of the magnetic carrier. The magnetic carrier is adhered to the surface of the developing roller 13 and is carried to the developing area where the photosensitive drum 14 and the developing roller 13 face each other. Due to a developing bias voltage applied between the developing roller 13 and the photosensitive drum 14, only the toner is supplied to the photosensitive drum 14 and thus the electrostatic latent image formed on the surface of the photosensitive drum 14 is developed into a visible image.

When a two-component development scheme is employed, the developer contained in the developer cartridge 20 may include a toner and a carrier. In this case, to constantly maintain a ratio of the carrier to the toner in the developing unit 10, a surplus amount of the carrier may be discharged outside the developing unit 10, and mat be contained in a waste developer container.

When a one-component development scheme using no carrier is employed, the developing roller 13 and the photosensitive drum 14 may rotate in contact with each other or apart from each other by several ten to several hundred microns. The developer contained in the developer cartridge 20 may be a toner.

A developing scheme of the image forming apparatus according to an embodiment has been described above in detail. However, the developing scheme is not limited thereto and may be variously changed or modified.

An exposer 50 is an element for forming electrostatic latent images on the photosensitive drums 14 by irradiating light modulated to correspond to image information, onto the photosensitive drums 14. A representative example thereof is a laser scanning unit (LSU) using a laser diode as a light source, or a light-emitting diode (LED) exposer using an LED as a light source.

An intermediate transfer belt 60 temporarily contains toner images developed on the photosensitive drums 14 of the developing units 10C, 10M, 10Y, and 10K. A plurality of intermediate transfer rollers 61 are provided to face the photosensitive drums 14 of the developing units 10C, 10M, 10Y, and 10K interposing the intermediate transfer belt 60 therebetween. An intermediate transfer bias voltage for intermediately transferring the toner images developed on the photosensitive drums 14, onto the intermediate transfer belt 60 is applied to the intermediate transfer rollers 61. Corona transferers or pin-scorotron transferers may be employed instead of the intermediate transfer rollers 61.

A transfer roller 70 is located to face the intermediate transfer belt 60. A transfer bias voltage for transferring the toner images transferred onto the intermediate transfer belt 60, onto a recording medium P is applied to the transfer roller 70.

A fuser 80 applies heat and/or pressure to the toner images transferred onto the recording medium P, and thus fixes the toner images on the recording medium P. The fuser 80 is not limited to the configuration illustrated in FIG. 1.

Due to the above-described configuration, the exposer 50 forms electrostatic latent images on the photosensitive drums 14 of the developing units 10C, 10M, 10Y, and 10K by irradiating light modulated to correspond to image information of a plurality of colors, onto the photosensitive drums 14 of which the surface is charged in a uniform electric potential by the charging roller 15. The electrostatic latent images of the photosensitive drums 14 of the developing units 10C, 10M, 10Y, and 10K are developed into visible toner images due to the C, M, Y, and K developers supplied from the developer cartridges 20C, 20M, 20Y, and 20K to the developing units 10C, 10M, 10Y, and 10K. The developed toner images are sequentially and intermediately transferred onto the intermediate transfer belt 60. The recording medium P accommodated in a feeding member 90 is fed along a feeding path 91 and is supplied between the transfer roller 70 and the intermediate transfer belt 60. The toner images intermediately transferred onto the intermediate transfer belt 60 are transferred onto the recording medium P due to a transfer bias voltage applied to the transfer roller 70. After the recording medium P passes through the fuser 80, the toner images are fixed on the recording medium P due to heat and pressure. The recording medium P, on which the toner images are completely fixed, is discharged by discharge rollers 92.

The developer contained in the developer cartridge 20 is supplied to the developing unit 10. When the developer contained in the developer cartridge 20 is completely consumed, the developer cartridge 20 may be replaced with a new developer cartridge 20, or a new developer may be filled in the developer cartridge 20.

The image forming apparatus may further include developer supply units 30. Each developer supply unit 30 receives the developer from the developer cartridge 20 and supplies the same to the developing unit 10. The developer supply unit 30 may be connected through a supply tube 40 to the developing unit 10.

Although not shown in FIG. 1, the developer supply unit 30 may be omitted and the supply tube 40 may directly interconnect the developer cartridge 20 and the developing unit 10.

Figure 2:
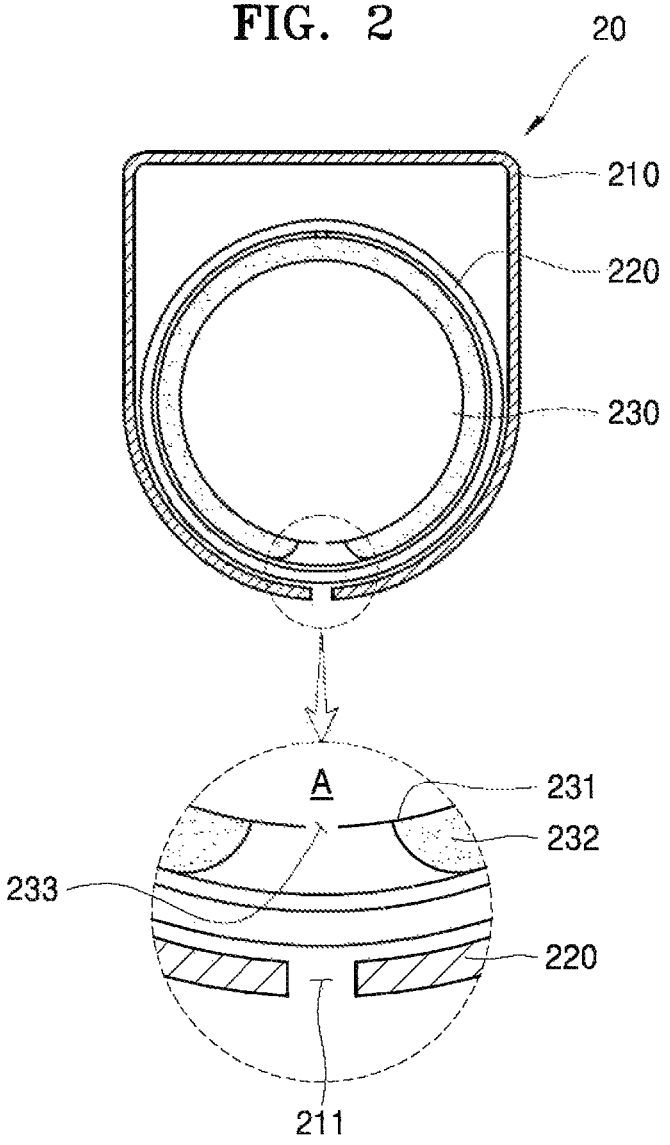
FIG. 2 is a schematic longitudinal sectional view of a developer cartridge according to an embodiment.
Figure 3:
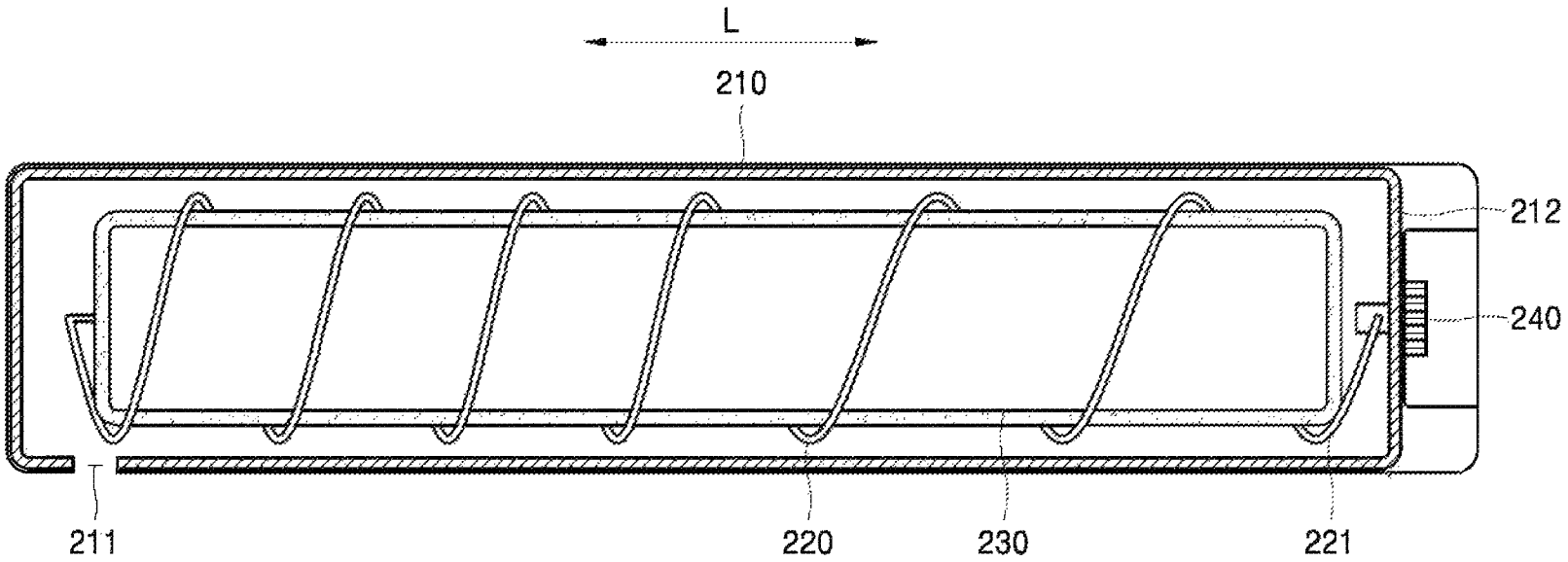
FIG. 3 is a transverse sectional view of a developer cartridge according to an embodiment.

FIG. 2 is a schematic longitudinal sectional view of the developer cartridge 20 according to an embodiment. FIG. 3 is a transverse sectional view of the developer cartridge 20 according to an embodiment. Referring to FIGS. 2 and 3, the developer cartridge 20 may include a housing 210, a spiral coil 220, and a developer bag 230.

The housing 210 is provided with a developer outlet 211. A developer is supplied to the developing unit 10 through the developer outlet 211. A supply line (40 of FIG. 1) may be connected to the developer outlet 211. Further, the developer outlet 211 may be connected to a supply unit (30 of FIG. 1). Also, although not shown in the drawing, the developer outlet 211 may be directly connected to the developing unit 10. The developer outlet 211 may be provided at one side of a longitudinal direction L of, for example, the housing 210.

A conveying member is provided inside the housing 210 for conveying the developer to the developer outlet 211 while being rotated. The conveying member may be a spiral member. The spiral coil 220 is an example of the conveying member. For example, a power transmission member 240 is provided on one side wall 212 in the longitudinal direction L of the housing 210. One end 221 of the spiral coil 220 is connected to the power transmission member 240. The power transmission member 240 may be, for example, a gear, a coupler, or the like. The power transmission member 240 may be connected to a motor (not shown) provided in the main body 1. The power transmission member 240 may be connected to a motor (not shown) provided in the developer cartridge 20. When the spiral coil 220 is rotated, the developer in the housing 210 is conveyed toward the developer outlet 211.

The developer is contained in the developer bag 230. The developer bag 230 is provided with an opening 233 through which the developer is discharged into the housing 210. The opening 233 may be provided at a position not overlapping with the developer outlet 211. For example, the opening 233 is spaced from the developer outlet 211 in the longitudinal direction L. If the opening 233 and the developer outlet 211 overlap each other, the developer discharged from the developer bag 230 through the opening 233 is directly discharged to the outside of the developer cartridge 20 through the developer outlet 211. Then, the developer is temporarily supplied excessively to the developing unit 10, which may cause a poor image density or developer leakage. According to the present embodiment, the developer discharged from the developer bag 230 through the opening 233 is conveyed in the longitudinal direction L by the spiral coil 220 inside the housing 210 and is conveyed to the developer outlet 211. Therefore, the developer may be stably and uniformly discharged through the developer outlet 211.

The developer bag 230 is installed in the housing 210 and rotated. For example, the developer bag 230 may be connected to the conveying member and rotated. In other words, the developer bag 230 may be rotated by a rotational force from the conveying member. In the present embodiment, the spiral coil 220 is employed as the conveying member, and the developer bag 230 is inserted into a central portion (an inner diameter portion) of the spiral coil 220. When the spiral coil 220 is rotated, the developer bag 230 is also rotated. An outer diameter of the developer bag 230 may be slightly larger than an inner diameter of the spiral coil 220. When the developer bag 230 is inserted into the inner diameter portion of the spiral coil 220, the spiral coil 220 presses the developer bag 230. The conveying member does not necessarily have to be the spiral coil 220 but may be in various forms having a central portion into which the developer bag 230 is inserted.

The developer bag 230 is formed of a flexible material. The developer bag 230 may be formed of a material having a surface with a low coefficient of friction. The developer bag 230 may be formed of, for example, a PE sheet (Polyethylene sheet), an LDPE sheet (Low Density Polyethylene sheet), or a PA sheet (Polyamide sheet). The developer bag 230 includes a flexible wall 231 and a support wall 232 for retaining a shape of the developer bag 230 filled with gas, e.g., air, therein. The flexible space 231 and the support wall 232 form an accommodation space A in which the developer is accommodated. The support wall 232 provides rigidity to the developer bag 230 so that the developer bag 230 does not twist when the developer main merge 230 is rotated.

Figure 4:
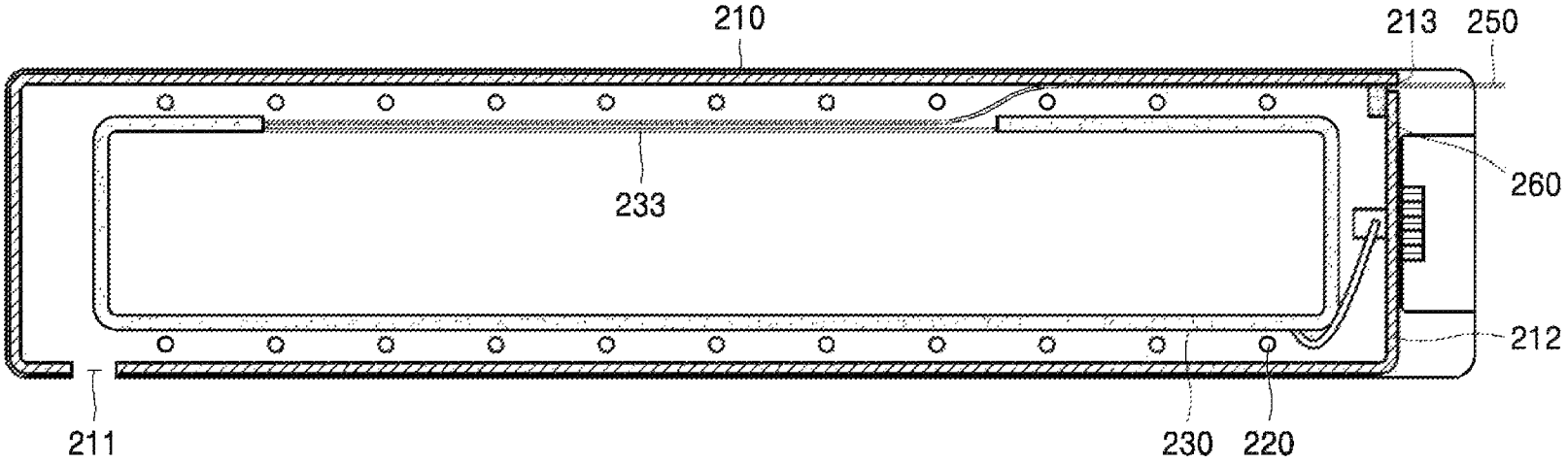
FIG. 4 is a schematic cross-sectional view of a developer cartridge according to an embodiment.

Before the developer cartridge 20 is mounted to the image forming apparatus main body 1, the opening 233 is kept in a sealed state. FIG. 4 is a schematic cross-sectional view of the developer cartridge 20 according to an embodiment. Referring to FIG. 4, a first sealing member 250 that seals the opening 233 is illustrated. The first sealing member 250 is attached to the flexible wall 231 to seal the opening 233. The first sealing member 250 is bent in a U-shape and extends to the outside of the housing 210 through an outlet 213 provided in the side wall 212 of the housing 210. When the first sealing member 250 is pulled and removed before the developer cartridge 20 is mounted on the main assembly 1, the opening 233 is opened. A second sealing member 260 may be provided to prevent the developer from leaking through the outlet 213. The second sealing member 260 may be formed of, for example, a sponge capable of being elastically deformed and restored.

Figure 5A:
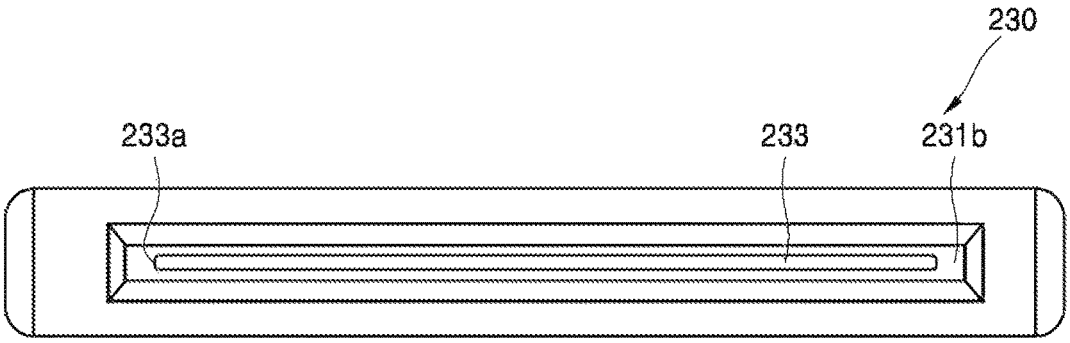
FIGS. 5A and 5B are a plan view and a cross-sectional view of a developer bag, respectively, according to an embodiment.
Figure 5B:
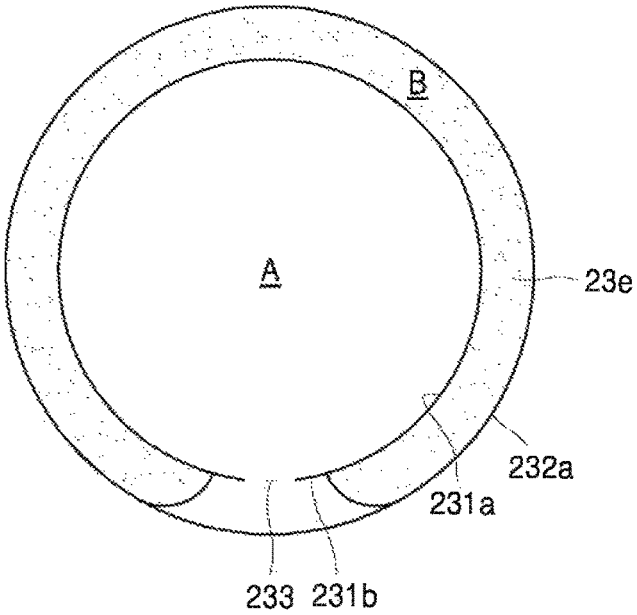

Shapes of the flexible wall 231 and the support wall 232 forming the developer bag 230 may vary. FIGS. 5A and 5B are a plan view and a cross-sectional view of the developer bag 230, respectively, according to an embodiment. Referring to FIGS. 5A and 5B, the developer bag 230 includes an inner wall 231*a* defining the accommodation space A and an outer wall 232*a* spaced apart and outward from the inner wall 231*a* to create, together with the inner wall 231*a*, a filling space B in which gas 23*e* is filled. The flexible wall 231 is realized by the inner wall 231*a*. The support wall 232 is realized by the inner wall 231*a* and the outer wall 232*a* which are spaced apart from each other. A part 231*b* of the inner wall 231*a* is exposed to the outside. An opening 233 is formed in the exposed part 231*b*. A corner 233*a* of the opening 233 has a round shape. Thereby, a possibility that the opening 233 is torn may be reduced. The opening 233 may be enclosed by the support wall 232. Thus, a shape of the opening 233 is maintained, and the developer may be easily discharged into the housing 210 through the opening 233.

The developer cartridge 20 shown in FIGS. 5A and 5B has a structure in which the support wall 232 is formed entirely outside the flexible wall 231 excluding the portion where the opening 233 is formed but the shape of the developer cartridge 20 is not limited thereto.

Figure 6A:
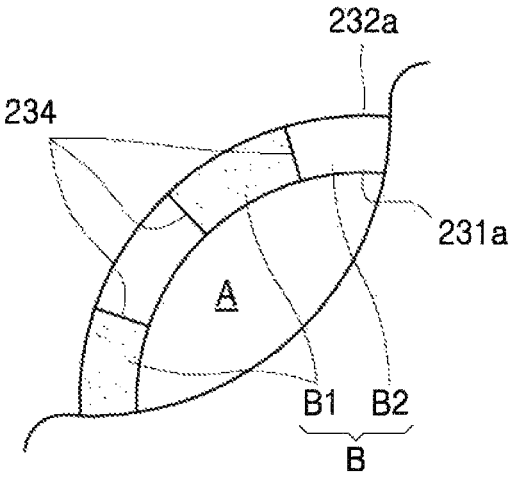
FIG. 6A is a partial longitudinal cross-sectional view of a developer bag according to an embodiment.

FIG. 6A is a partial longitudinal cross-sectional view of the developer bag 230 according to an embodiment. Referring to FIG. 6A, a plurality of partition walls 234 are provided between the inner wall 231 a and the outer wall 232*a*. A filling space B between the inner wall 231 a and the outer wall 232*a* may be divided into a first space B1 in which gas is filled and a second space B2 in which gas is not filled due to the plurality of partition walls 234. The first space B1 and the second space B2 may extend in the longitudinal direction L of the developer bag 230.

Figure 6B:
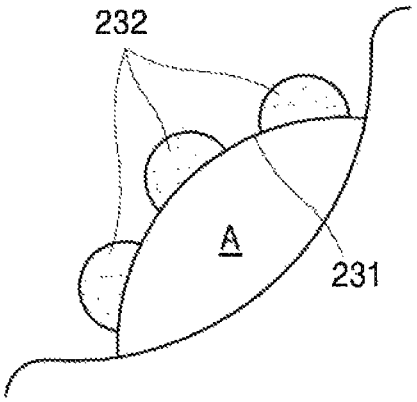
FIG. 6B is a partial longitudinal cross-sectional view of a developer bag according to an embodiment.

FIG. 6B is a partial longitudinal cross-sectional view of the developer bag 230 according to an embodiment. Referring to FIG. 6B, the accommodation space A is formed by the flexible wall 231, and the plurality of support walls 232 that are convex outward with respect to the flexible wall 231 may be arranged in a circumferential direction of the flexible wall 231. The plurality of support walls 232 may extend in the longitudinal direction L of the developer bag 230.

Figure 6C:
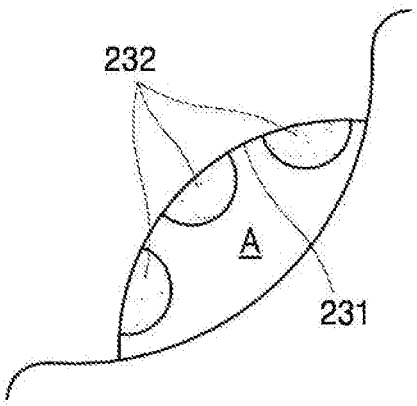
FIG. 6C is a partial longitudinal cross-sectional view of a developer bag according to an embodiment.

FIG. 6C is a partial longitudinal cross-sectional view of the developer bag 230 according to an embodiment. Referring to FIG. 6C, the accommodation space A is formed by the flexible wall 231, and the plurality of support walls 232 that are convex inward with respect to the flexible wall 231 may be arranged in a circumferential direction of the flexible wall 231. The plurality of support walls 232 may extend in the longitudinal direction L of the developer cartridge 20.

Figure 6D:
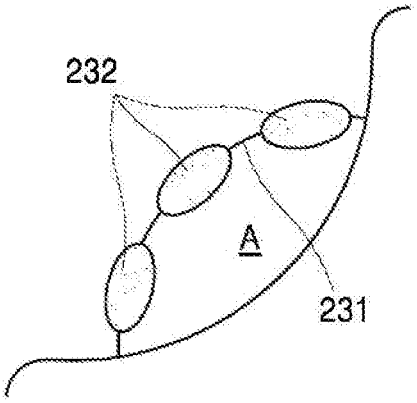
FIG. 6D is a partial longitudinal cross-sectional view of a developer bag according to an embodiment.

FIG. 6D is a partial longitudinal cross-sectional view of the developer bag 230 according to an embodiment. Referring to FIG. 6D, the accommodation space A is formed by the flexible wall 231, and the plurality of support walls 232 that are convex inward and outward with respect to the flexible wall 231 may be arranged in a circumferential direction of the flexible wall 231. The plurality of support walls 232 may extend in the longitudinal direction L of the developer bag 230.

Figure 7A:
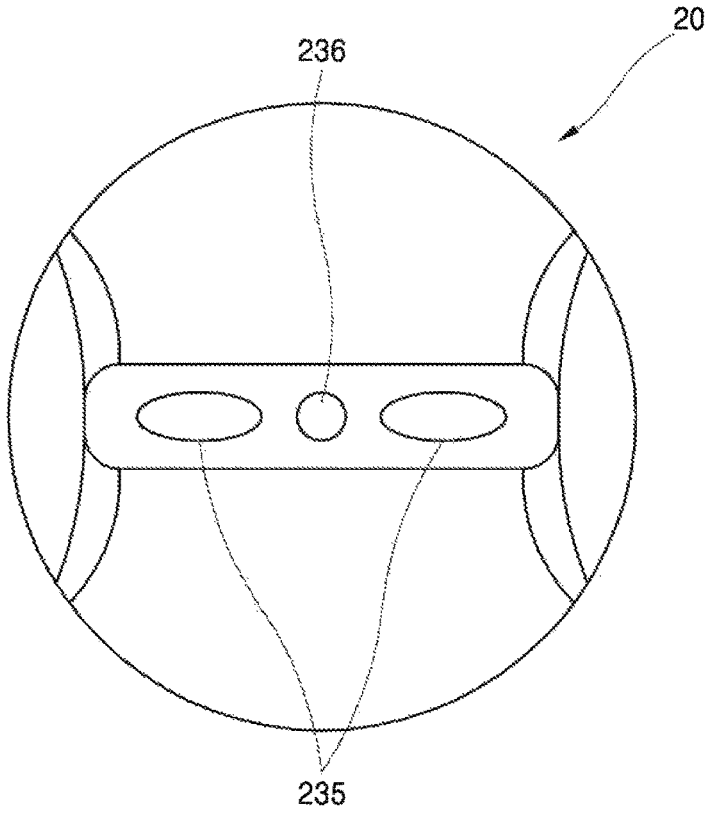
FIGS. 7A and 7B are side views of a developer bag showing an example of a structure for filling the developer bag with a developer and gas.
Figure 7B:
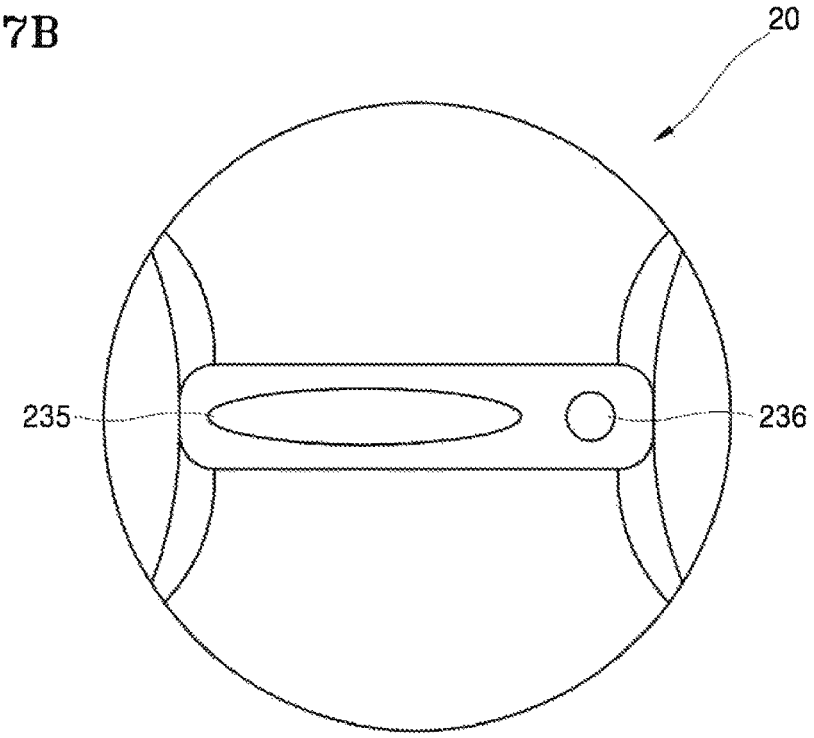

The developer bag 230 may be provided with a structure to be filled with a developer and gas. FIGS. 7A and 7B are side views of the developer bag 230, showing an example of a structure to be filled with the developer and gas. Referring to FIGS. 7A and 7B, one end of the developer bag 230 is provided with the developer loading inlet 235 communicating with the accommodation space A and a gas filling inlet 236 communicating with the filling space B of the support wall 232. The numbers and shapes of the developer loading inlet 235 and the gas filling inlet 236 are not limited to the examples shown in FIGS. 7A and 7B.

In FIG. 6A, the plurality of first spaces B1 may communicate with the gas filling inlet 236 in series or in parallel. In FIGS. 6B, 6C, and 6D, the plurality of support walls 232 may communicate with the gas filling inlet 236 in series or in parallel. Gas is injected into the filling space B through the gas filling inlet 236. The support wall 232 is formed, and the developer bag 230 is expanded to form the accommodation space A. When gas filling is completed, the gas filling inlet 236 is closed by, for example, heat fusion, ultrasonic welding or the like. A shape of the developer bag 230 is maintained by the support wall 232.

The developer is loaded into the accommodation space A through the developer loading inlet 235 with the opening 233 closed by the first sealing member 250. The shape of the developer bag 230 is maintained by the support wall 232, and thus the developer may be stably loaded into the accommodation space A. Thereafter, the developer loading inlet 235 may be closed by, for example, heat fusion, ultrasonic fusion, or the like.

The developer bag 230 filled with gas and loaded with the developer is inserted into the central portion (the inner diameter portion) of the spiral coil 220. The first sealing member 250 is removed before the developer cartridge 20 is mounted on the main assembly 1. Then, the developer is discharged into the housing 210 through the opening 233. When the spiral coil 220 is rotated, the developer bag 230 rotates together. The inner developer inside the developer bag 230 may be easily discharged into the housing 210 through the opening 233 by the rotation of the developer bag 230.

In case of a conventional developer cartridge in which the developer bag 230 is not employed, the developer may be unevenly distributed in the housing 210 in a longitudinal direction as the developer is consumed. In this case, the spiral coil 220 is partly overloaded, and there is a danger of disconnection of a drive motor (not shown) and deformation or breakage of the spiral coil 220. According to the developer cartridge 20 of the present embodiment employing the developer bag 230, since the developer bag 230 is inserted into the central portion of the spiral coil 220, and a shape of the developer bag 230 is maintained, an excessive driving load is not applied to the spiral coil 220, and a risk of deformation of the spiral coil 220 may be reduced. Also, the developer in the developer bag 230 may be held in a powder state without being clustered by the rotational vibration and the elasticity of the developer bag 230.

In case of the conventional developer cartridge in which the developer bag 230 is not employed, since the spiral coil 220 and the developer are continuously in contact with each other, stress may accumulate on the developer, thereby deteriorating the developer property. According to the developer cartridge 20 of the present embodiment employing the developer bag 230, since the developer is supplied from the inside of the developer bag 230 to the housing 210, a contact time between the developer and the spiral coil 220 may be reduced, and thus the developer stress may be alleviated, and the property of the developer may be stably maintained.

In case of the conventional developer cartridge in which the developer bag 230 is not employed, a manufacturing process includes a filling process of filling the developer directly to the housing 210. Therefore, when a problem occurs in the filling process, the entire manufacturing process is affected. According to the developer cartridge 20 of the present embodiment in which the developer bag 230 is employed, the process of filling the developer in the developer bag 230 may be realized as an independent process, the developer bag 230 in which the developer is filled may be supplied as a part to the manufacturing process of the developer cartridge 20. Therefore, the process efficiency may be improved. Further, since the developer is not exposed to the outside in the manufacturing process of the developer cartridge 20, the process cleanliness may be improved.

Figure 8A:
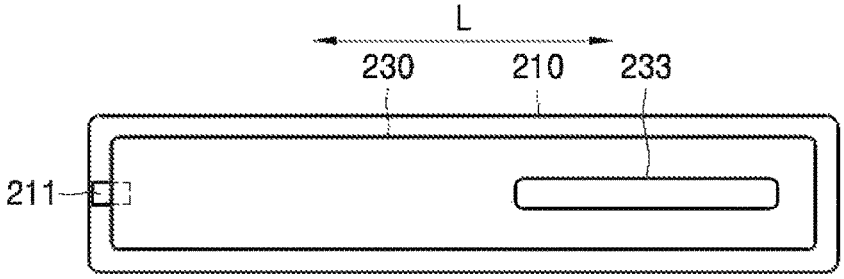
FIGS. 8A through 8G show examples of a shape of an opening.
Figure 8B:
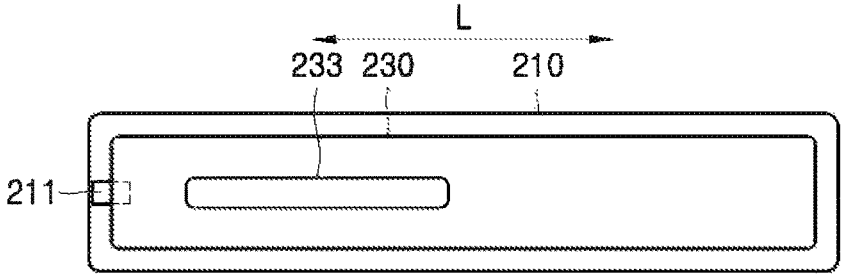
Figure 8C:
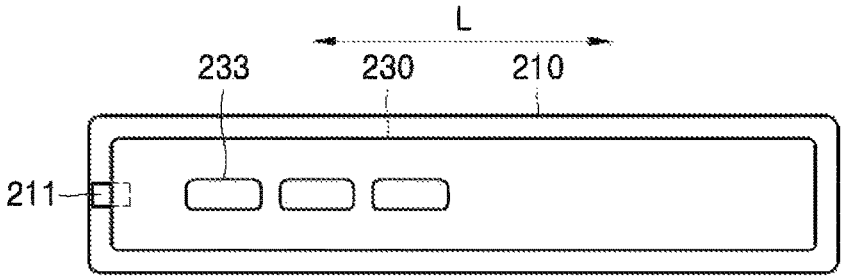
Figure 8D:
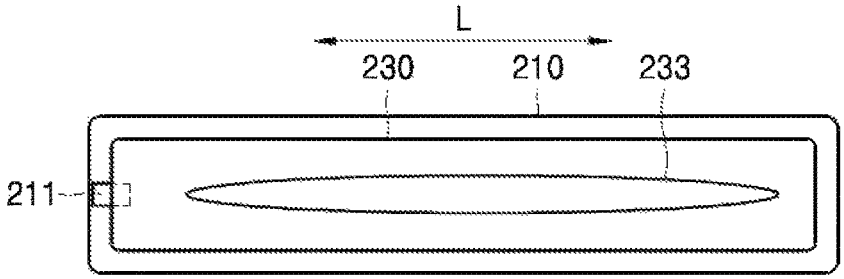
Figure 8E:
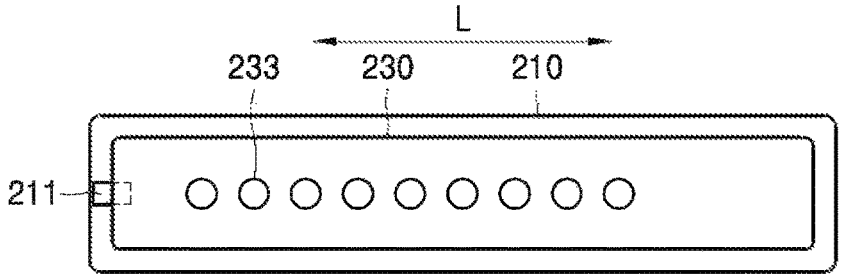
Figure 8F:
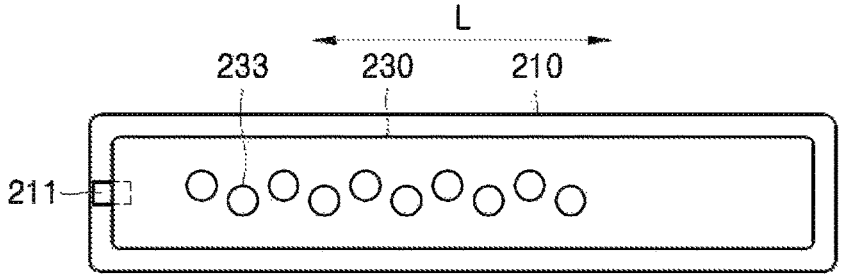
Figure 8G:
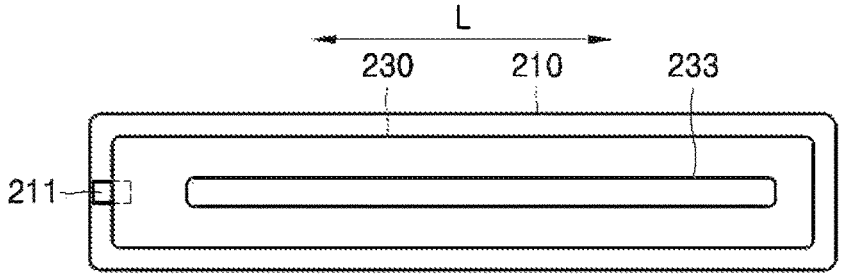

The shape and the number of the openings 233 are not particularly limited as long as the openings 233 and the developer outlet 211 do not overlap each other. FIGS. 8A through 8G show examples of a shape of the opening 233. As shown in FIGS. 8A, 8B, 8C, and 8D, the opening 233 may have a rectangular shape. At this time, corners may be rounded so that the opening 233 is not tom. The opening 233 may be positioned on the opposite side of the developer outlet 211 in the longitudinal direction L of the developer bag 230 as shown in FIG. 8A. The opening 233 may be positioned nearer to the developer outlet 211 in the longitudinal direction L of the developer bag 230 as shown in FIG. 8B. The plurality of openings 233 may be arranged in the longitudinal direction L as shown in FIG. 8C. The opening 233 may be elongated from the opposite end of the developer outlet 211 to a position not overlapping the developer outlet 211 as shown in FIG. 8G. As shown in FIG. 8D, the opening 233 may be elliptical with a long axis in the longitudinal direction L. The plurality of circular openings 233 may be arranged in the longitudinal direction L as shown in FIG. 8E. As shown in FIG. 8F, the plurality of circular openings 233 may be arranged in a zigzag manner in the longitudinal direction L.

Figure 9A:
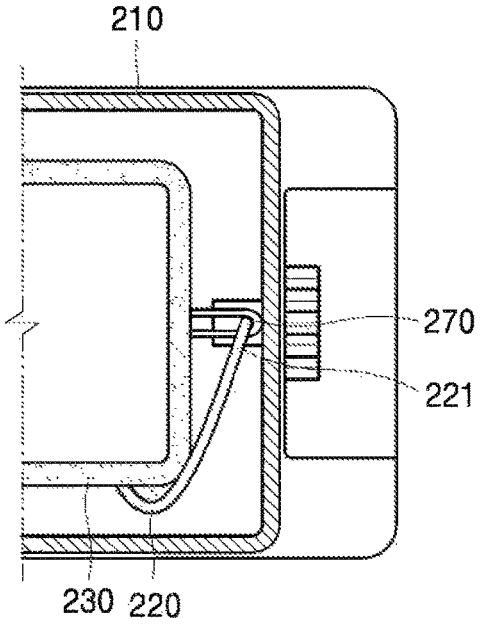
FIG. 9A is a partial cross-sectional view of a developer cartridge according to an embodiment.

The developer bag 230 is inserted into the inner diameter portion of the spiral coil 220 and rotated together with the spiral coil 220 as described above. At this time, a thrust force is applied to the developer bag 230 by the spiral coil 220 so that the developer bag 230 may be pushed toward the developer discharge port 211. When the developer bag 230 is continuously pushed toward the developer outlet 211, after the developer bag 230 contacts a side wall of the housing 210 on the side of the developer outlet 211, the spiral coil 220 is compressed and the developer bag 230 may be released from the spiral coil 220. FIG. 9A is a partial cross-sectional view of the developer cartridge 20 according to an embodiment. Referring to FIG. 9A, a stopper 270 is provided in the developer bag 230. The stopper 270 may include a hook which is caught at an end portion 221 of the spiral coil 220, for example, the opposite end of the developer outlet 211 of the spiral coil 220. Thus, the developer bag 230 may be prevented from being pushed toward the developer discharge port 211.

Figure 9B:
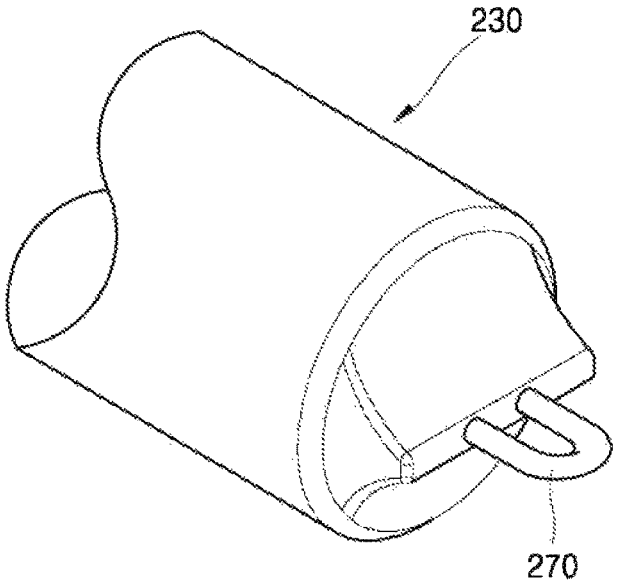
FIGS. 9B and 9C are perspective views of a developer bag in which a stopper is employed, according to an embodiment.
Figure 9C:
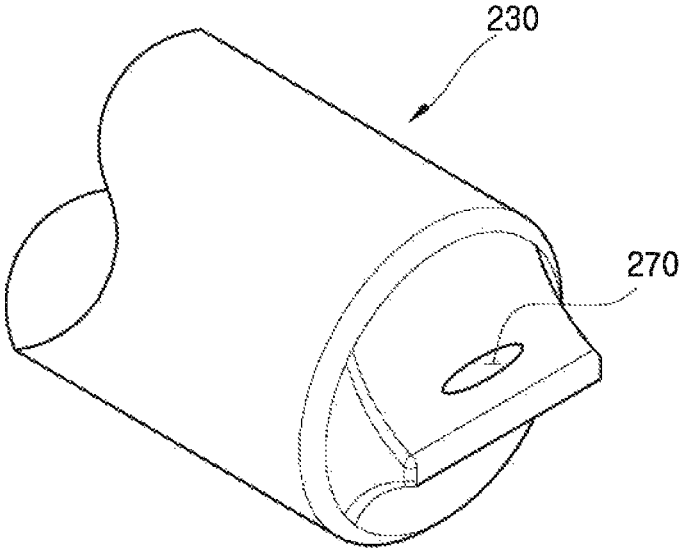

FIGS. 9B and 9C are perspective views of the developer bag 230 in which the stopper 270 is employed according to an embodiment. As shown in FIG. 9B, the stopper 270 may include a ring protruding from an end of the developer bag 230. As shown in FIG. 9C, the stopper 270 may include a ring that passes through the end of the developer bag 230.

Figure 10:
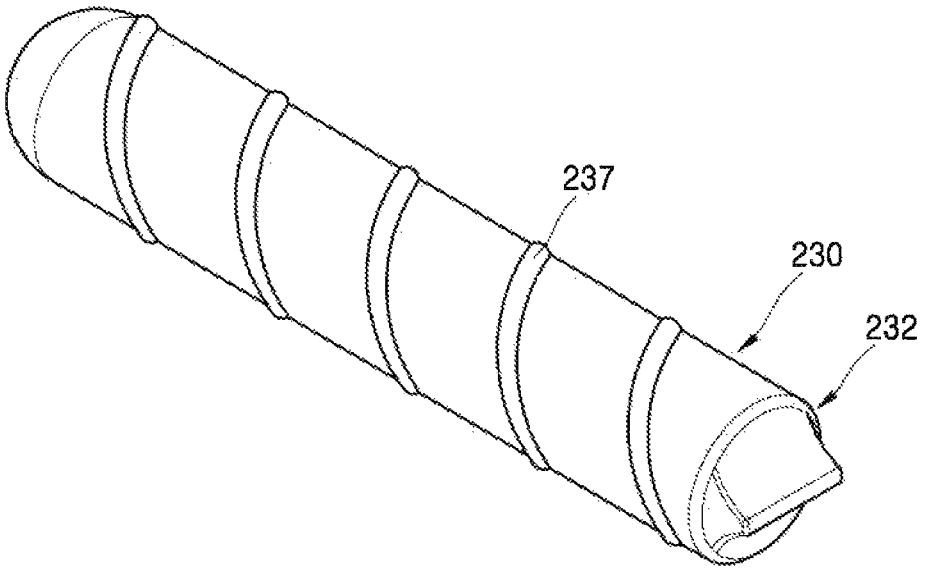
FIG. 10 is a perspective view of a developer bag according to an embodiment.

FIG. 10 is a perspective view of the developer bag 230 according to an embodiment. Referring to FIG. 10, a part of the support wall 232 forming the developer bag 230 has a spiral shaped portion 237 projecting outwardly from the developer bag 230. A spiral direction of the spiral shaped portion 237 is the same as a spiral direction of the spiral coil 220. According to this configuration, when the developer bag 230 rotates together with the spiral coil 220, the developer inside the housing 210 may be conveyed to the developer outlet 211 by the spiral portion 237. Therefore, the developer may be stably and effectively conveyed to the developer outlet 211.

Figure 11A:
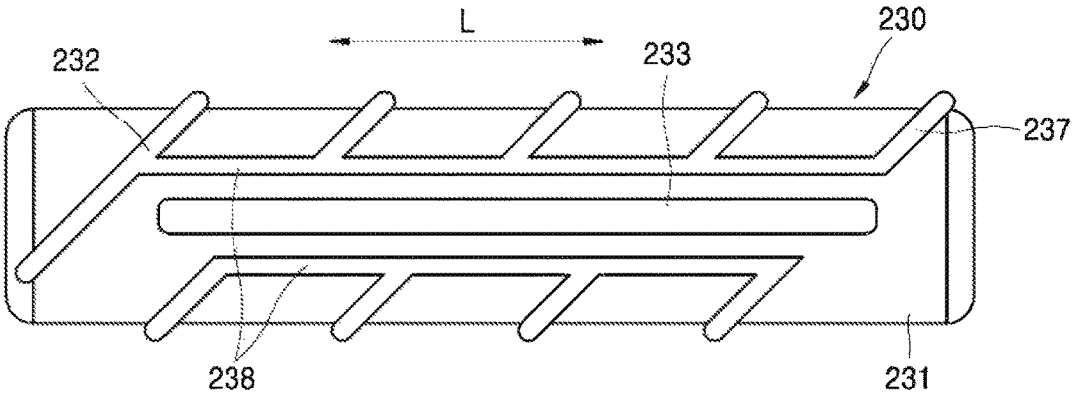
FIGS. 11A and 11B are plan views showing a shape of an opening of a developer bag shown in FIG. 10, according to an embodiment.
Figure 11B:
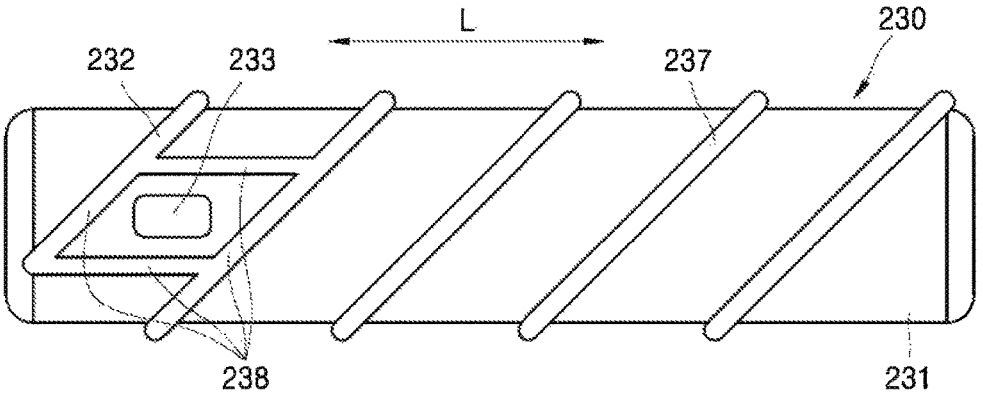

FIGS. 11A and 11B are plan views showing a shape of the opening 233 of the developer bag 230 shown in FIG. 10 according to an embodiment. Referring to FIG. 11A, the support wall 232 includes an opening forming wall 238 extending in the longitudinal direction L around the opening 233 to maintain the shape of the opening 233. Referring to FIG. 11B, the support wall 232 includes an opening forming wall 238 that surrounds the opening 233 with the spiral shaped portion 237 to maintain the shape of the opening 233. As a result, a shape in which the opening 233 is formed in the flexible wall 231 surrounded by the spiral shaped portion 237 and the opening forming wall 238 may be realized.

While one or more embodiments have been described with reference to the figures, it will be understood by those of ordinary skill in the art that various changes in form and details may be made therein without departing from the spirit and scope as defined by the following claims.

What is claimed is:

1. A developer cartridge comprising:

a housing comprising a developer outlet;

a conveying member to convey a developer in the housing to the developer outlet, and comprising a spiral member rotatably installed in the housing; and a developer bag to accommodate the developer, be installed in the housing and inserted into the spiral member such that the spiral member circumferentially surrounds the developer bag, and to rotate with the spiral member, the developer bag comprising an opening through which the developer is discharged into the housing.

2. A developer cartridge, comprising:

a housing comprising a developer outlet a conveying member to convey a developer in the housing to the developer outlet, and comprising a spiral member rotatably installed in the housing; and a developer bag to accommodate the developer, be installed in the housing, and rotate with the spiral member, the developer bag comprising:

an opening through which the developer is discharged into the housing, a flexible wall, and a support wall filled with gas to maintain a shape of the developer bag.

3. The developer cartridge of claim 2, wherein the support wall is shaped to be convex inward with respect to the flexible wall.

4. The developer cartridge of claim 2, wherein the support wall is shaped to be convex outward with respect to the flexible wall.

5. The developer cartridge of claim 2, wherein the support wall is shaped to be convex inward and outward with respect to the flexible wall.

6. The developer cartridge of claim 2, wherein the opening is provided in the flexible wall, and wherein the support wall comprises an opening forming wall located around the opening to maintain a shape of the opening.

7. The developer cartridge of claim 6, wherein the opening forming wall surrounds the opening.

8. The developer cartridge of claim 6, wherein corners of the opening have a curved shape.

9. The developer cartridge of claim 6, further comprising a first sealing member removably attached to the flexible wall to seal the opening.

10. The developer cartridge of claim 9, wherein one end of the first sealing member extends outside of the housing.

11. The developer cartridge of claim 10, wherein a sealing member outlet through which the first sealing member is discharged is provided in the housing, and the developer cartridge further comprises: a second sealing member to prevent leakage of a developer through the sealing member outlet.

12. The developer cartridge of claim 2, wherein the support wall comprises a spiral shaped portion having a same spiral direction as that of the conveying member.

13. A developer cartridge, comprising:

a housing comprising a developer outlet;

a conveying member to convey a developer in the housing to the developer outlet and comprising a spiral member rotatably installed in the housing; and a developer bag to accommodate the developer, be installed in the housing, and rotate with the spiral member, the developer bag comprising an opening through which the developer is discharged into the housing, wherein the opening does not overlap with the developer outlet.

14. A developer cartridge, comprising:

a housing comprising a developer outlet a conveying member to convey a developer in the housing to the developer outlet, the conveying member comprising a spiral coil rotatably installed in the housing; and, a developer bag to accommodate the developer, be installed in the housing and inserted into a central portion of the spiral coil, and to rotate with the spiral coil, the developer bag comprising an opening through which the developer is discharged into the housing.

15. The developer cartridge of claim 14, wherein an outermost diameter of the developer bag is greater than an inner diameter of the central portion of the spiral coil.

16. A developer cartridge, comprising:

a housing comprising a developer outlet a conveying member to convey a developer in the housing to the developer outlet, and comprising a spiral member rotatably installed in the housing, a developer bag to accommodate the developer, be installed in the housing, and rotate with the spiral member, the developer bag comprising an opening through which the developer is discharged into the housing; and a stopper to prevent the developer bag from being moved to the developer outlet by a thrust force according to a rotation of the conveying member.

17. The developer cartridge of claim 16, wherein the stopper comprises a hook provided in the developer bag and caught by the conveying member.

18. An electrophotographic image forming apparatus comprising:

a main body comprising a developing unit to supply a developer to a photoconductor to form a visible toner image; and a developer cartridge to supply the developer to the developing unit, the developer cartridge comprising:

a housing comprising a developer outlet;

a conveying member to convey the developer in the housing to the developer outlet, and comprising a spiral member rotatably installed in the housing; and a developer bag to accommodate the developer, be installed in the housing and inserted into the spiral member such that the spiral member circumferentially surrounds the developer bag, and to rotate with the spiral member, the developer bag comprising an opening through which the developer is discharged into the housing.

19. The electrophotographic image forming apparatus of claim 18, wherein the developer bag comprises:

a flexible wall, and a support wall filled with gas to maintain a shape of the developer bag.

20. The electrophotographic image forming apparatus of claim 18, wherein the opening of the developer bag does not overlap with the developer outlet of the housing.

* * * * *